US008879928B2

(12) United States Patent
Watanabe

(10) Patent No.: US 8,879,928 B2
(45) Date of Patent: Nov. 4, 2014

(54) IMAGE FORMING APPARATUS

(75) Inventor: Yasunari Watanabe, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 220 days.

(21) Appl. No.: 13/532,613

(22) Filed: Jun. 25, 2012

(65) Prior Publication Data

US 2013/0004187 A1 Jan. 3, 2013

(30) Foreign Application Priority Data

Jun. 29, 2011 (JP) ..... 2011-144645

(51) Int. Cl.
*G03G 15/08* (2006.01)
*G03G 15/00* (2006.01)

(52) U.S. Cl.
CPC ..... *G03G 15/556* (2013.01); *G03G 15/0831* (2013.01)
USPC ..... 399/29

(58) Field of Classification Search
CPC ..... G03G 15/556; G03G 15/0848; G03G 15/0831; G03G 15/0856
USPC ..... 399/29, 27, 31, 24
See application file for complete search history.

(56) References Cited

U.S. PATENT DOCUMENTS

| | | | | |
|---|---|---|---|---|
| 5,649,264 | A | 7/1997 | Domon | |
| 6,931,218 | B2 * | 8/2005 | Kakeshita et al. | 399/27 |
| 2005/0025506 | A1 | 2/2005 | Adachi | |
| 2006/0140651 | A1 * | 6/2006 | Hirobe et al. | |
| 2009/0297177 | A1 | 12/2009 | Shimizu | |
| 2010/0166439 | A1 | 7/2010 | Nishimura | |
| 2014/0072314 | A1 * | 3/2014 | Miyahara et al. | 399/27 |

FOREIGN PATENT DOCUMENTS

| | | | |
|---|---|---|---|
| EP | 1731973 | A1 | 12/2006 |
| JP | 5-6092 | A | 1/1993 |
| JP | 2001-318566 | A | 11/2001 |
| JP | 2009-080185 | A | 4/2009 |
| JP | 2009-288586 | A | 12/2009 |
| JP | 2010-156792 | A | 7/2010 |

* cited by examiner

*Primary Examiner* — Susan Lee
(74) *Attorney, Agent, or Firm* — Canon USA Inc. IP Division

(57) ABSTRACT

An image forming apparatus includes a control device configured to control an information signal that notifies a user of a coming shortage of the developer in a developer storage portion or a usage limit of the developing device. The control device can transmit the information signal in such a way that the amount of the developer remaining in the developer storage portion at the transmission timing of the information signal is variable according to a developer consumption amount per unit number of recording material sheets.

1 Claim, 17 Drawing Sheets

FIG. 9

| | | RESIDUAL DEVELOPER AMOUNT THRESHOLD Z |
|---|---|---|
| PREDETERMINED DEVELOPER CONSUMPTION RATE WO | W1 | Z6 |
| | W2 | Z5 |
| | W3 | Z4 |
| | W4 | Z3 |
| | W5 | Z2 |
| | W6 | Z1 |

$W1<W2<W3<W4<W5<W6$
$Z1<Z2<Z3<Z4<Z5<Z6$

IMAGE FORMING APPARATUS

BACKGROUND OF THE INVENTION

1. Field of the Invention

The present invention relates to an electrophotographic image forming apparatus that is capable of forming an image on a recording material (i.e., a recording medium), such as a sheet. More specifically, the present invention relates to an image forming apparatus, such as a copying machine or a printer.

2. Description of the Related Art

In an image forming apparatus using electrophotographic image forming processes, a method for notifying or estimating the amount of a developer remaining in a developing device is conventionally disclosed.

As discussed in Japanese Patent Application Laid-Open No. 5-6092, as a method for directly detecting the amount of a developer, it is conventionally known to detect an electrostatic capacity amount that is variable depending on the amount of a developer remaining in a developing device and calculate the residual developer amount based on the detected electrostatic capacity amount. Further, as discussed in U.S. Pat. No. 5,649,264, a combination of an infrared light-emitting diode (LED) and a light-receiving sensor is usable to detect the amount of a remaining developer.

Further, as a method for indirectly estimating the amount of a developer, as discussed in Japanese Patent Application Laid-Open No. 2001-318566, it is conventionally known that a developer consumption rate can be estimated based on image information (e.g., pixel count value) in an image forming operation and the remaining amount detection can be performed based on the estimation result.

Further, as a representative configuration of the electrophotographic image forming apparatus capable of simplifying the replenishment of the developer or the maintenance of the developing device, it is conventionally known that the developing device can be configured as a "developing cartridge" that is detachable from the main body of the image forming apparatus. Further, it is conventionally known that the developing device can be integrally formed with a photosensitive member and other process units as a "process cartridge" that is detachable from the main body of the image forming apparatus.

Further, as another configuration of the electrophotographic image forming apparatus capable of simplifying the replenishment of the developer or the maintenance of the developing device, it is conventionally known that the developing device can be configured as a "developing process cartridge" that is detachable from the main body of the image forming apparatus. Further, it is conventionally known that the developing device can be integrally formed with a photosensitive member and other process units as a "process cartridge" that is detachable from the main body of the image forming apparatus.

Further, it is conventionally known to provide a notification unit (e.g., a display unit) in the above-described developing process cartridge to measure the remaining developer amount (i.e., the residual developer amount) in a developer container and warns about a coming shortage of the residual developer. Further, the notification unit (e.g., the display unit) can be used to notify a user of a usage limit of the developing cartridge and encourage the user to exchange developing cartridges.

In this case, a control device sets an appropriate warning level to generate warning in a state where a certain amount of developer still remains in a developer container and encourage a user to exchange developing cartridges. The reason why the above-described warning setting is required is because, for example, an image defective may occur because of the presence of a developer deviating along the longitudinal direction of a developer carrier (e.g., a developing roller) if the developer is used continuously until the developer container becomes empty.

However, the following problems will arise if the notification unit (e.g., the display unit) is configured to display a warning message (or indication) when the remaining developer amount reaches a predetermined threshold level. More specifically, if the image forming apparatus performs formation of images at lower print rates, the image defective may occur at early timing before the remaining developer amount reaches the threshold level (i.e., in a state where a relatively larger amount of developer remains and the warning is not yet required). More specifically, it is generally believed that the deterioration degree of the developer stored in a developer storage container is relatively higher if the print rate is lower compared to the deterioration degree in a case where the print rate is higher.

For example, the relationship between the print rate and the deterioration of the developer will be described below. The developer includes resin particles containing pigment (as base material) and external additives (such as lubricant and charge control agent). The developer can obtain a desired amount of electric charge when the developer is rubbed by a developing blade on the developer carrier.

However, the external additives may be embedded between the resin particles when the developer is rubbed by the developing blade to obtain the desired amount of electric charge.

If the external additives are completely embedded between the resin particles, the developer cannot obtain the desired amount of electric charge any more. This phenomenon is generally referred to as the "deterioration of the developer." The deteriorated developer possibly causes an image defective because the obtainable charge amount is insufficient.

If the developer obtains the desired charge amount by the developing blade, the developer is conveyed to a predetermined position of a developing portion where an image carrier is brought into a confronting relationship with the developer carrier in such a way as to develop an electrostatic latent image. On the other hand, if the developer has not been used in the development of an electrostatic latent image, the developer is conveyed into the developer storage container.

The developer, if it has not been used in the development of an electrostatic latent image and returned to the developer storage container, is already in a deteriorated state because the developer has been rubbed sufficiently by the developing blade. Therefore, when the image forming apparatus performs formation of images at lower print rates, the percentage of the developer not having been used in the development of an electrostatic latent image increases. As a result, the percentage of the deteriorated developer returned to the developer storage container portion increases.

Accordingly, the entire deterioration degree of the developer existing in the developer storage container becomes higher when the image forming apparatus prints a greater number of images at lower print rates, compared to a case where the image formation is performed at higher print rates.

From the foregoing description, it is generally believed that the image defective possibly occurs at early timing before the remaining developer amount reaches a predetermined threshold level if the image forming apparatus prints many images at lower print rates.

SUMMARY OF THE INVENTION

The present invention is directed to an image forming apparatus capable of generating information relating to the warning of the remaining developer amount or information relating to the exchange of developing cartridges, at optimum timing, in various usage histories. Thus, the image forming apparatus according to the present invention can use the developer for along time, without causing any image defective, while taking a print rate of each formed image into consideration.

According to an aspect of the present invention, an image forming apparatus performs image formation on a recording material. The image forming apparatus includes an image carrier carrying a developer image, a developing device including a developer storage portion that stores a developer and configured to develop an electrostatic latent image formed on the image carrier, a remaining amount detection device configured to detect information relating to the remaining amount of the developer stored in the developer storage portion, and a control device configured to transmit an information signal relating to a usage limit of the developing device based on information relating to the remaining amount of the developer. The control device is configured to transmit the information signal in such a way that the amount of the developer remaining in the developer storage portion at the transmission timing of the information signal is variable according to an average developer consumption rate.

The image forming apparatus according to the exemplary embodiment of the present invention can generate information relating to the warning of the remaining developer amount or information relating to the exchange of developing cartridges, at optimum timing, in various usage histories. The image forming apparatus according to the exemplary embodiment of the present invention can use the developer for a long time, without causing any image defective, while taking a print rate of each formed image into consideration.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 9 is a table illustrating a relationship between predetermined developer consumption rate and residual developer amount threshold according to the fourth exemplary embodiment of the present invention.

DESCRIPTION OF THE EMBODIMENTS

Various exemplary embodiments, features, and aspects of the invention will be described in detail below with reference to the drawings.

The present invention relates to an image forming apparatus that includes a control device capable of controlling an information signal notifying that the remaining amount of a developer stored in a developer storage portion becomes smaller or that the usage limit of a developing device will soon come.

The control device can transmit an information signal in such a way as to change the amount of the developer remaining in the developer storage portion according to a print rate (i.e., the amount of the developer consumed per unit number of sheets of the recording material) when the information signal is transmitted. An example is described below.

Figure 1:
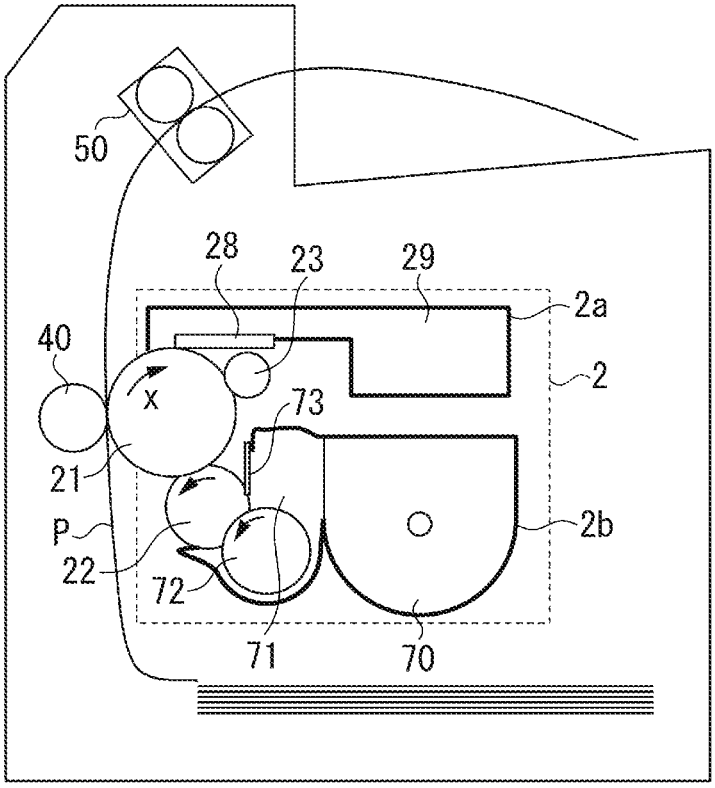
FIG. 1 illustrates a schematic configuration of an image forming apparatus according to an exemplary embodiment of the present invention.

FIG. 1 illustrates a schematic configuration of an image forming apparatus according to a first exemplary embodiment of the present invention. The image forming apparatus includes a photosensitive member 21 that serves as an image carrier. The following process units are operative together with the photosensitive member 21 and disposed around the photosensitive member 21. A charging device can charge the photosensitive member 21. A developing device 2*b* can develop an electrostatic latent image, which is formed by exposing the charged photosensitive member 21 to light, into a developer image with a developer. A transfer device can transfer the developer image formed on the photosensitive member 21 to a transferred member, such as a recording material or an intermediate transfer member. A cleaning blade 28 can remove the remaining non-transferred developer off the photosensitive member 21. A discharged developer storage container 29 can store the remaining non-transferred toner having been cleaned.

In the present exemplary embodiment, a charging roller 23 serving as the charging device, a developing roller 22 (i.e., a developer carrier) of the developing device 2*b*, a transfer roller 40 serving as the transfer device, and the cleaning blade 28 are disposed in such a way as to be brought into contact with the photosensitive member 21.

The photosensitive member 21, the charging roller 23, and the cleaning blade 28 are integrated with the discharged developer storage container 29 to form a photosensitive member unit 2*a*.

The developing device 2*b* has a casing that is configured as a developer container 71 including a developer storage portion 70 that serves as the developer storage portion. The developer container 71 is configured as a developing unit in which the developing roller 22, a developer feed roller 72, a developing blade 73, and a developer agitating member 74 serving as an agitating unit are provided. The developing device 2*b* is hereinafter referred to as "developing unit 2*b*." The developing roller 22 is disposed in a confronting relationship with the photosensitive member 21.

An image forming operation that can be performed by the image forming apparatus according to the present exemplary embodiment is described below. The photosensitive member 21 rotates at a predetermined speed in the direction indicated by an arrow X when the photosensitive member 21 is driven by a driving mechanism (not illustrated). A charging bias is applied to the charging roller 23 by a power source (not illustrated) to charge the surface of the photosensitive member 21 uniformly at a predetermined electric potential. A laser exposure device (not illustrated) exposes the charged surface of the photosensitive member 21 to laser light to form a latent image on the charged surface of the photosensitive member 21.

The latent image formed on the surface of the photosensitive member 21 is conveyed to a contact portion of the developing roller 22 where the latent image can be visualized as a developer image with the developer D supplied by the developing roller 22. In the present exemplary embodiment, the developer D is a nonmagnetic one-component developer. A developing bias is applied to the developing roller 22 by the power source (not illustrated).

The visualized developer image is conveyed to a contact portion of the transfer roller 40 in accordance with the rotation of the photosensitive member 21, and is transferred to the surface of a recording material P (i.e., a medium to which the image is transferred) that is conveyed in synchronization with the rotation of the photosensitive member 21. A transfer bias is applied to the transfer roller 40 by the power source (not illustrated).

The recording material P onto which the developer image has been transferred is conveyed to a fixing device 50. The fixing device 50 applies heat and pressure to the recording material P so that the transferred developer image is fixed on the recording material P.

On the other hand, the non-transferred developer D (i.e., residual developer) on the photosensitive member 21 is scraped off by the cleaning blade 28 and stored in the discharged developer storage container 29. After the residual developer is removed, the surface of the photosensitive member 21 is charged by the charging roller 23 again to repeat the above-described image forming operation.

According to the image forming apparatus illustrated in FIG. 1, the photosensitive member unit 2*a* and the developing unit 2*b* are integrated together as a process cartridge 2 to be detachable from the image forming apparatus.

Figure 2:
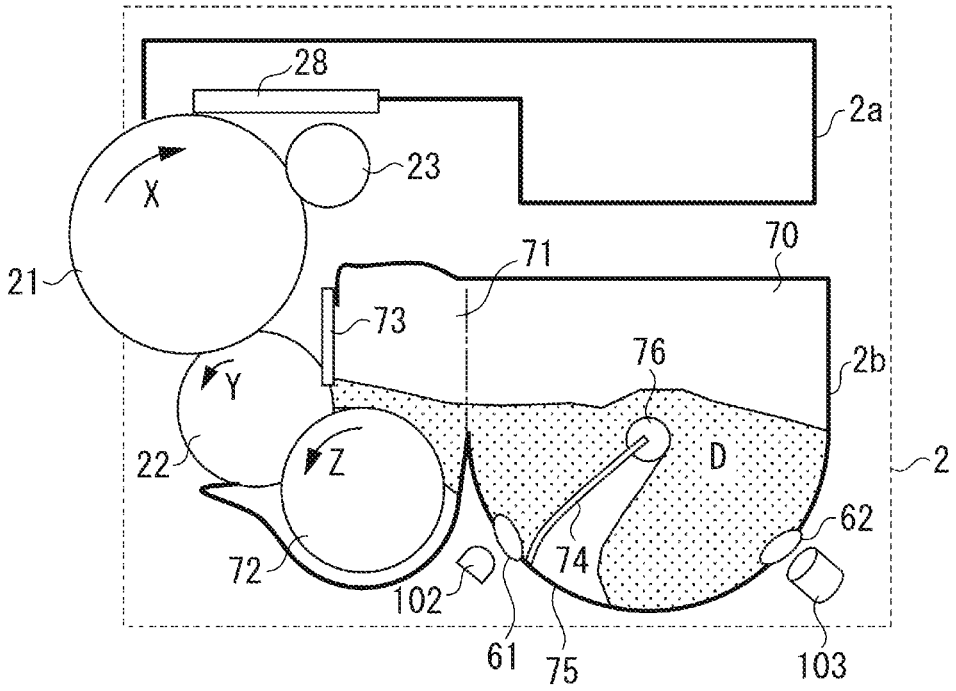
FIG. 2 is a schematic cross-sectional view of a process cartridge according to an exemplary embodiment of the present invention.

Next, the developing unit 2*b* according to the present exemplary embodiment is described in detail below with reference to FIG. 2. FIG. 2 illustrates a schematic cross-sectional view of the process cartridge 2.

In the developing unit 2*b*, the developing roller 22 and the developer feed roller 72 are rotatable freely and supported by the developer container 71. The developer feed roller 72 is disposed in such a way as to be brought into contact with a cylindrical surface of the developing roller 22. The developing roller 22 rotates in a direction indicated by an arrow Y indicated in FIG. 2. The developer feed roller 72 rotates in a direction indicated by an arrow Z. In other words, the developing roller 22 and the developer feed roller 72 rotate in the same direction (the opposite direction at a cylindrical surface of the contact portion).

The developing roller 22 includes a metallic core that is surrounded by a conductive elastic rubber layer that has a predetermined volume resistivity. The developer feed roller 72 includes a metallic core that is surrounded by a urethane foam layer. The urethane foam layer has a surface layer provided with foam cells that are opened to surely hold and convey the developer D.

The developing blade 73 is constituted by an elastic plate, such as a flexible phosphor bronze plate. The developing blade 73 has one end fixed to the developer container 71. The developing blade 73 has a free end disposed in such a way as to be brought into frictional contact with the conductive elastic rubber layer surface of the developing roller 22.

The developer agitating member 74 is provided in the developer storage portion 70 and is rotatable around a rotational shaft 76. The developer agitating member 74 has a distal end portion 75 that is disposed in such a way as to be brought into contact with the bottom surface of the developer storage portion 70. Two light transmission windows 61 and 62 (i.e., an input light transmission window 61 and an output light transmission window 62) are provided on the bottom surface of the developer storage portion 70.

The distal end portion 75 of the developer agitating member 74 is configured to be brought into contact with the light transmission windows 61 and 62 of the developer storage portion 70. The distal end portion 75 can temporarily move the developer D on the light transmission windows 61 and 62. In other words, the developer agitating member 74 can clean the light transmission windows 61 and 62 with the distal end portion 75 thereof.

Next, the movement of the developer in the currently operating developing unit 2*b* is described below. When the developing unit 2*b* is driven by a driving mechanism (not illustrated), each of the developing roller 22, the developer feed roller 72, and the developer agitating member 74 rotates in the arrow direction illustrated in FIG. 2.

When the developer agitating member 74 rotates in the developer storage portion 70, the developer D is stirred in the developer storage portion 70 (in the developing unit) and is conveyed toward the developer feed roller 72.

The developer D held on the urethane foam layer of the developer feed roller 72 is conveyed to the contact portion of the developing roller 22 in accordance with the rotation of the developer feed roller 72. The developer D, when it has reached the contact portion, is rubbed by the surfaces of the developing roller 22 and the developer feed roller 72 that are rotating in mutually opposite directions. A part of the developer D is transferred toward the developing roller 22. Thus, the developer D adheres to the surface of the developing roller 22.

The developer D adhering to the surface of the developing roller 22 is conveyed to the developing blade 73 in accordance with the rotation of the developing roller 22. The developing blade 73 can regulate the amount of the developer D adhering to the surface of the developing roller 22 in such a way as to form a uniform thin layer. Further, the developing blade 73 can frictionally charge the developer D.

The thin-layered developer D can be conveyed to a contact portion of the photosensitive member 21 in accordance with the rotation of the developing roller 22, and can be used to develop the latent image on the photosensitive member 21. If a part of the developer D remains on the surface of the developing roller 22 without being used for the development, the remaining developer D is conveyed to a contact portion of the developer feed roller 72. The developer feed roller 72 removes the remaining developer D from the surface of the developing roller 22.

The removed developer D is returned to the developer storage portion 70, and then stirred and mixed with the developer D stored in the developer storage portion 70.

Next, a light-transmission type developer amount detection method employed in the present exemplary embodiment is described below with reference to FIG. 2.

The image forming apparatus includes a light-emitting unit 102 that can emit light to detect the remaining amount of the developer, and a light-receiving unit 103 that can receive the light having passed through the developer storage portion 70. In the present exemplary embodiment, the light-emitting unit 102 is a light-emitting diode (LED) and the light-receiving unit 103 is a photo transistor (PTR). The light-transmission type developer amount detection method is characterized in that the light passes across the inner space of the developer storage portion 70 to detect the remaining amount of the developer.

If there is not any developer D in the developer storage portion 70, the light from the light-emitting unit 102 enters into the developer storage portion 70 from the light transmission window 61. The light passes across the inside space of the developer storage portion 70 and exits from the light transmission window 62 to the light-receiving unit 103. If the developer D is sufficiently stored in the developer storage portion 70, the light is shielded by the developer D on the optical path extending from the light transmission window 61 to the light transmission window 62. Therefore, the light cannot reach the light-receiving unit 103.

In the configuration according to the present exemplary embodiment, the developer agitating member 74 is rotating at a predetermined time interval during a developer amount detection operation. At its setup position, the developer agitating member 74 blocks the optical path. Therefore, even in a case where the developer D is not present in the developer storage portion 70, the light-receiving duration and the light-shielding duration alternately appear in accordance with the rotational period of the developer agitating member 74.

If a certain amount of developer D remains in the developer storage portion 70, the remaining developer D is conveyed by the distal end portion 75 of the developer agitating member 74. Therefore, the light-shielding duration becomes longer compared to the case where the developer D is not present.

The light-shielding duration corresponds to the amount of the developer D remaining in the developer storage portion 70. Accordingly, it is possible to detect the amount of the developer D remaining in the inner space of the developer storage portion 70 by measuring the rate of the light-shielding duration while the developer agitating member 74 makes a complete revolution (hereinafter, referred to as "agitating period"). Alternatively, comparable remaining amount detection can be realized by comparing the rate of the light-receiving duration (not the rate of the light-shielding duration).

Figure 3:
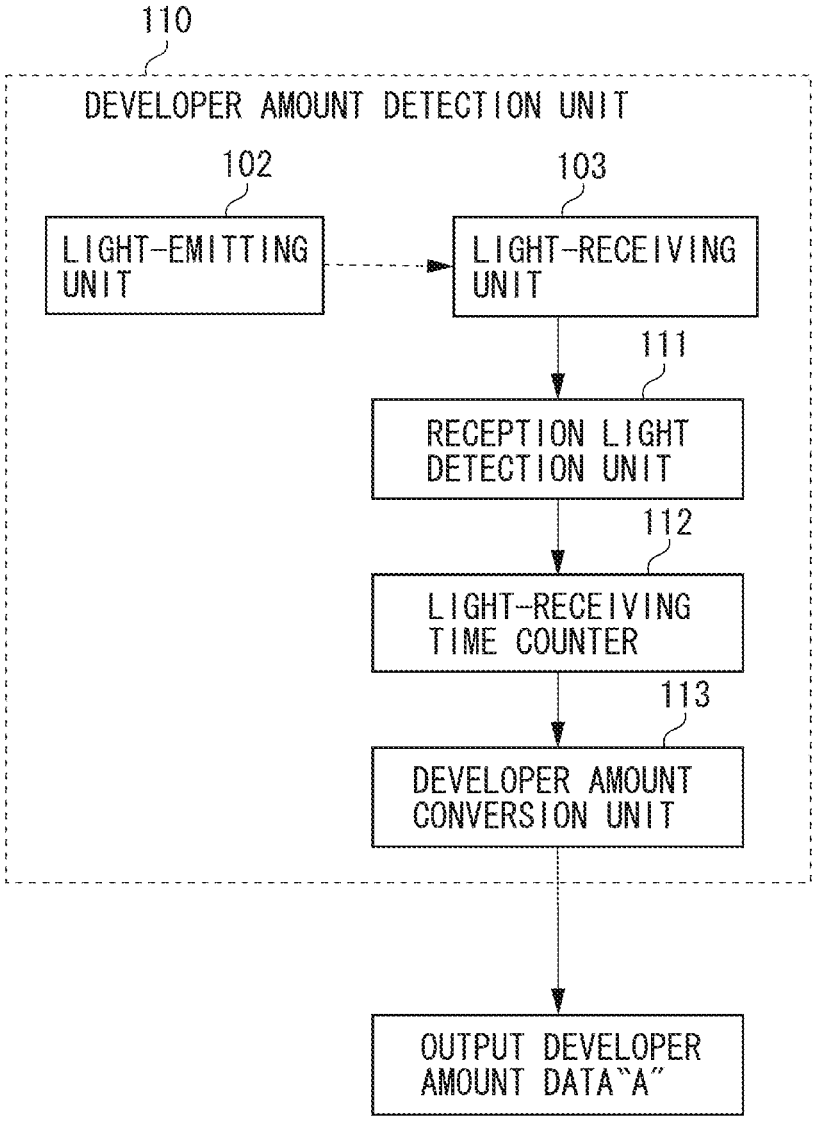
FIG. 3 is a block diagram illustrating a circuit configuration of a developer amount detection unit according to an exemplary embodiment of the present invention.

FIG. 3 is a block diagram illustrating a circuit configuration of a developer amount detection unit 110 according to the present exemplary embodiment.

As illustrated in FIG. 3, the developer amount detection unit 110 (i.e., a light remaining amount detection device) includes a reception light detection unit 111, a light-receiving time counter 112, and a developer amount conversion unit 113, in addition to the light-emitting unit 102 and the light-receiving unit 103.

The light-receiving unit 103 outputs a signal representing the received light to the reception light detection unit 111. Only when the intensity of the received light is equal to or greater than a predetermined level, the reception light detection unit 111 sends an output signal (hereinafter, referred to as "reception light signal") to the light-receiving time counter 112. The light-receiving time counter 112 measures the time interval of the reception light signal, and sends a measurement value to the developer amount conversion unit 113. The developer amount conversion unit 113 calculates the amount of the developer stored in the developer storage portion 70 based on the measurement value obtained by the light-receiving time counter 112 and the agitating period. Then, the developer amount conversion unit 113 sends developer amount data "A" to a control unit 140.

An average consumption rate conversion unit 120 (i.e., a calculation device) configured to estimate an average developer consumption rate of the image forming operation is described below. In the present exemplary embodiment, the average developer consumption rate represents the consumption amount of the developer per unit number of recording material sheets.

In general, the consumption amount of the developer becomes greater in proportion to the pixel information (i.e., the number of pixel signals (i.e., pixel count number)) of an output image, as image information of an image formed on a recording material in an image forming operation. The average developer consumption rate can be obtained by dividing the developer consumption amount by a reference area of a recording material.

More specifically, the following formula is employable to calculate a developer consumption rate W of an image formed on a recording material.

$$W=PC\div KS \tag{1}$$

In the present exemplary embodiment, W represents the developer consumption rate, PC represents the pixel count value, and KS represents the area of the recording material. In the present exemplary embodiment, the recording material area KS is calculated based on the A4 recording paper. The developer consumption rate according to the present exemplary embodiment may be generally referred to as "print rate." In general, the developer consumption amount per unit number of recording material sheets increases when the print rate is higher, in a case where the image formation is performed using recording material sheets having the same area.

Figure 4:
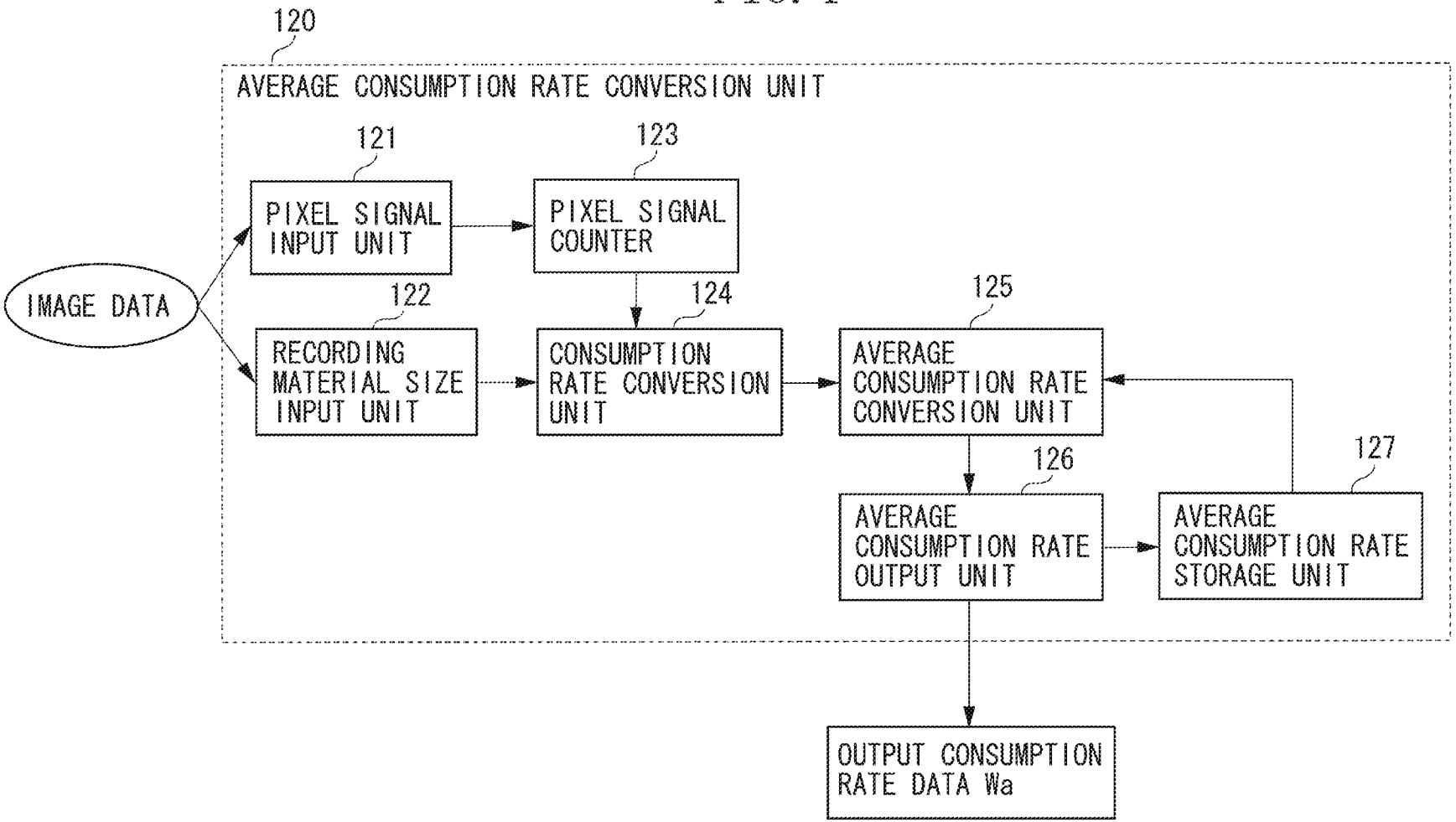
FIG. 4 is a block diagram illustrating a circuit configuration of a developer consumption amount calculation unit according to an exemplary embodiment of the present invention.

FIG. 4 is a block diagram illustrating a circuit configuration of the average consumption rate conversion unit 120 according to the present exemplary embodiment.

As illustrated in FIG. 4, the average consumption rate conversion unit 120 includes a pixel signal input unit 121, a recording material size input unit 122, a pixel signal counter 123, a consumption rate conversion unit 124, an average consumption rate conversion unit 125, an average consumption rate output unit 126, and an average consumption rate storage unit 127.

The image forming apparatus includes a formatter capable of rasterizing image data received from an external device to obtain image data converted into a size of an output image, i.e., the area of a recording material, and a pixel signal of an output image. The converted pixel signal is input to the pixel signal input unit 121 and formed into a signal having an appropriate data format that can be easily counted by the pixel signal counter 123.

The area information of the recording material is input to the recording material size input unit 122, and is sent to the consumption rate conversion unit 124. The pixel signal counter 123 counts the pixel signal having a predetermined time interval that has been formed by the pixel signal input unit 121, and sends a count value to the consumption rate conversion unit 124. The consumption rate conversion unit 124 obtains a converted developer consumption rate W of the image data received from the external device using the above-described formula (1) and sends the obtained value to the average consumption rate conversion unit 125.

The average consumption rate conversion unit 125 updates consumption rate data Wa by averaging the developer consumption rate W sent from the consumption rate conversion unit 124 and consumption rate data Wa stored in the average consumption rate storage unit 127. The average consumption rate conversion unit 125 sends the obtained new consumption rate data Wa to the average consumption rate output unit 126.

The average consumption rate output unit 126 stores the new information in the average consumption rate storage unit 127. Further, the average consumption rate output unit 126 outputs the new information, as the consumption rate data Wa of the developing unit 2*b*, to the control unit 140.

Figure 5:
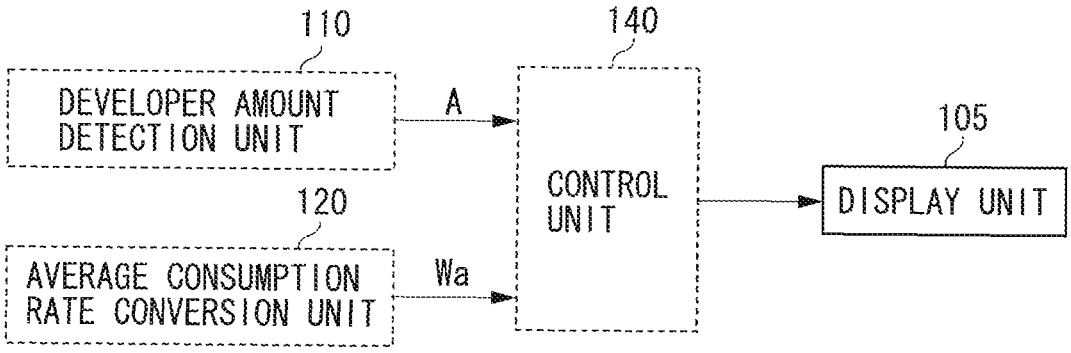
FIG. 5 is a block diagram illustrating a control system according to a first exemplary embodiment of the present invention.

FIG. 5 is a block diagram illustrating a control system according to the present exemplary embodiment. As illustrated in FIG. 5, the control unit 140 receives the detection data "A" from the developer amount detection unit 110 and the consumption rate data Wa from the average consumption rate conversion unit 120. The control unit 140 is connected to the display unit 105 of the image forming apparatus, and outputs information to the display unit 105.

An example control that can be performed by the control unit 140 is described in detail below with reference to a sequence diagram illustrated in FIG. 6.

In step S101, a print signal is sent to the image forming apparatus. In step S102, the image forming apparatus starts an image forming operation and the developing unit 2*b* starts its operation. Further, in step S103, image information received together with the print signal is sent to the average consumption rate conversion unit 120. In step S104, the average consumption rate conversion unit 120 calculates the consumption rate data Wa.

In step S106, the control unit 140 compares the consumption rate data Wa with a predetermined developer consumption rate W0 having been set beforehand (see step S105). If it is determined that the consumption rate data Wa is equal to or smaller than the predetermined developer consumption rate W0 (NO in step S106), then in step S108, the control unit 140 sets a residual developer amount threshold Z to Z1. Further, if it is determined that the predictive consumption rate data Wa is greater than the predetermined developer consumption rate W0 (YES in step S106), then in step S107, the control unit 140 sets the residual developer amount threshold Z to Z0. In the present exemplary embodiment, the residual developer amount threshold Z0 is smaller than the residual developer amount threshold Z1 (i.e., Z0<Z1).

On the other hand, in step S109, the developer amount detection unit 110 detects the developer amount data "A." Then, in step S111, the control unit 140 compares the detected developer amount data "A" with the residual developer amount threshold Z (see step S110). If it is determined that the developer amount data "A" is smaller than the residual developer amount threshold Z (YES in step S111), then in step S112, the control device transmits an information signal. In response to the information signal, the display unit 105 notifies a user of a coming shortage of the developer.

Through the above-described control according to the present exemplary embodiment, the control device changes the residual developer amount threshold Z according to the consumption rate data Wa calculated by the average consumption rate conversion unit 120. More specifically, the control device sets a relatively greater value with respect to the residual developer amount threshold Z if the consumption rate data Wa is smaller, compared to a value to be set in a case where the consumption rate data Wa is greater. On the other hand, the control device sets a relatively smaller value with respect to the residual developer amount threshold Z if the consumption rate data Wa is greater, compared to a value to be set in a case where the consumption rate data Wa is smaller.

Accordingly, for example, it is now presumed that there are two, i.e., first and second, image forming conditions. The second image forming condition is smaller in print rate than the first image forming condition. In other words, because of smallness in print rate, the developer consumption amount per unit area of a recording material according to the second image forming condition becomes smaller compared to that of the first image forming condition, during a time duration from the initial usage stage of the developing unit 2*b* until the control device transmits the information signal.

If the image forming apparatus performs an image forming operation according to each of the above-described two conditions, a difference will be recognized in the amount of the developer remaining in the discharged developer storage container 29 at the time when the control device transmits the information signal.

According to the first image forming condition, the residual developer amount threshold Z becomes a smaller value because the consumption rate data Wa becomes greater. Therefore, at the time when the control device transmits the information signal (i.e., the time when a coming shortage of the developer is notified), the amount of the developer remaining in the developer storage container according to the first image forming condition becomes smaller compared to that according to the second image forming condition.

When the above-described control is performed, the residual developer amount threshold Z becomes greater if the consumption rate data Wa is smaller. Therefore, it becomes possible to leave the warning as it is before an image defective occurs due to deterioration of the developer.

On the other hand, the image defective due to deterioration of the developer may not occur when the consumption rate data Wa is greater. The residual developer amount threshold Z becomes smaller when the consumption rate data Wa is greater. Therefore, compared to the case where the consumption rate data Wa is smaller, the developing unit 2*b* can be used effectively until the remaining amount of the developer becomes a smaller value.

In the first exemplary embodiment, the control device obtains the average developer consumption rate (i.e., the index indicating the deterioration degree of the developer) by dividing the developer consumption amount by the reference area of a recording material. However, as described above, it is generally believed that the deterioration of the developer gradually advances in accordance with the rotation of the developing roller that carries the developer.

Hence, in the present exemplary embodiment, the control device obtains the average developer consumption rate by diving the developer consumption amount by the rotation time of the developing roller. The image forming apparatus according to the present invention has a system configuration similar to that described in the first exemplary embodiment, and therefore the description thereof is not repeated. An average developer consumption rate conversion unit according to the present exemplary embodiment is described below.

The average consumption rate conversion unit 120 (i.e., a calculation device) that is configured to estimate an average developer consumption rate in an image forming operation according to the second exemplary embodiment is described below.

The following formula is employable to calculate a developer consumption rate W of an image.

$$W=PC\div Tdr \quad (2)$$

In the present exemplary embodiment, W represents the developer consumption rate, PC represents the pixel count value, and Tdr represents the rotation time of the developing roller. In the present exemplary embodiment, the control device updates the developer consumption rate W at a predetermined time interval. For example, the control device can update the developer consumption rate W at the time when the image formation of a single recording paper is completed or at the time when the image formation of a predetermined number of recording papers is completed.

Figure 7:
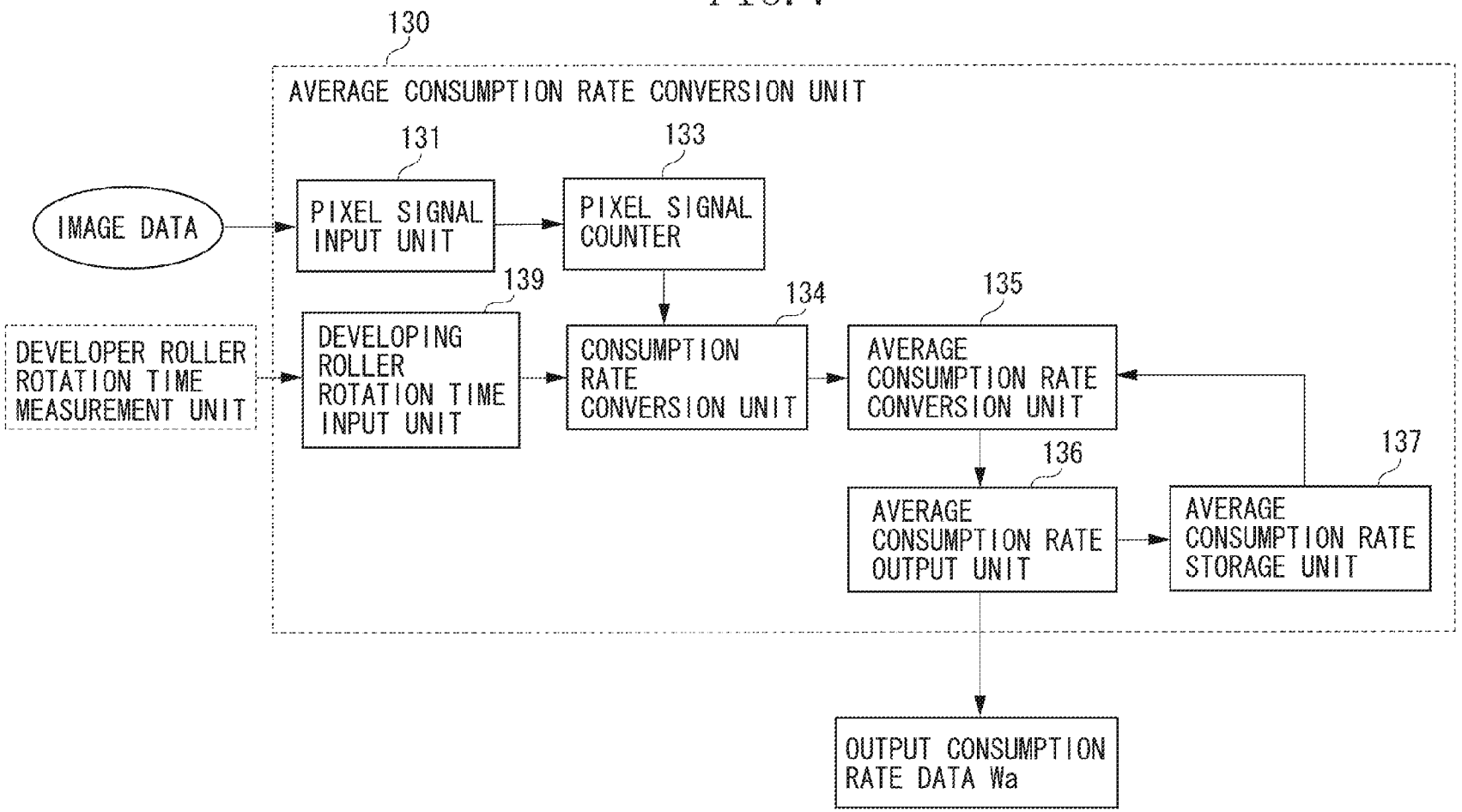
FIG. 7 is a block diagram illustrating a circuit configuration of a developer consumption amount calculation unit according to a second exemplary embodiment of the present invention.

FIG. 7 is a block diagram illustrating a circuit configuration of an average consumption rate conversion unit 130 according to the present exemplary embodiment. As illustrated in FIG. 7, the average consumption rate conversion unit 130 includes a pixel signal input unit 131, a developing roller rotation time input unit 139, a pixel signal counter 133, a consumption rate conversion unit 134, an average consumption rate conversion unit 135, an average consumption rate output unit 136, and an average consumption rate storage unit 137.

The pixel signal is input to the pixel signal input unit 131 and formed into a signal having an appropriate data format that can be easily counted by the pixel signal counter 133.

The rotation time DT of the developing roller 22 is substantially similar to the driving time of the driving mechanism of the developing unit 2*b*. Therefore, the developing roller rotation time input unit 139 receives developing roller rotation time information from a driving time measurement unit of the driving mechanism (not illustrated) of the developing unit 2*b*, and sends the received developing roller rotation time information to the consumption rate conversion unit 134.

The pixel signal counter 133 counts the pixel signal having predetermined time interval that has been formed by the pixel signal input unit 131 and sends a count value to the consumption rate conversion unit 134. The consumption rate conversion unit 134 obtains a converted developer consumption rate W of the image data received from the external device using the above-described formula (2), and sends the obtained value to the average consumption rate conversion unit 135.

The average consumption rate conversion unit 135 updates consumption rate data Wa by averaging the developer consumption rate W sent from the consumption rate conversion unit 134 and consumption rate data Wa stored in the average consumption rate storage unit 137. The average consumption rate conversion unit 135 sends the obtained new the consumption rate data Wa to the average consumption rate output unit 136.

The average consumption rate output unit 136 stores the new information in the average consumption rate storage unit 137. Further, the average consumption rate output unit 136 outputs the new information, as the consumption rate data Wa of the developing unit 2*b*, to the control unit 140.

Figure 6:
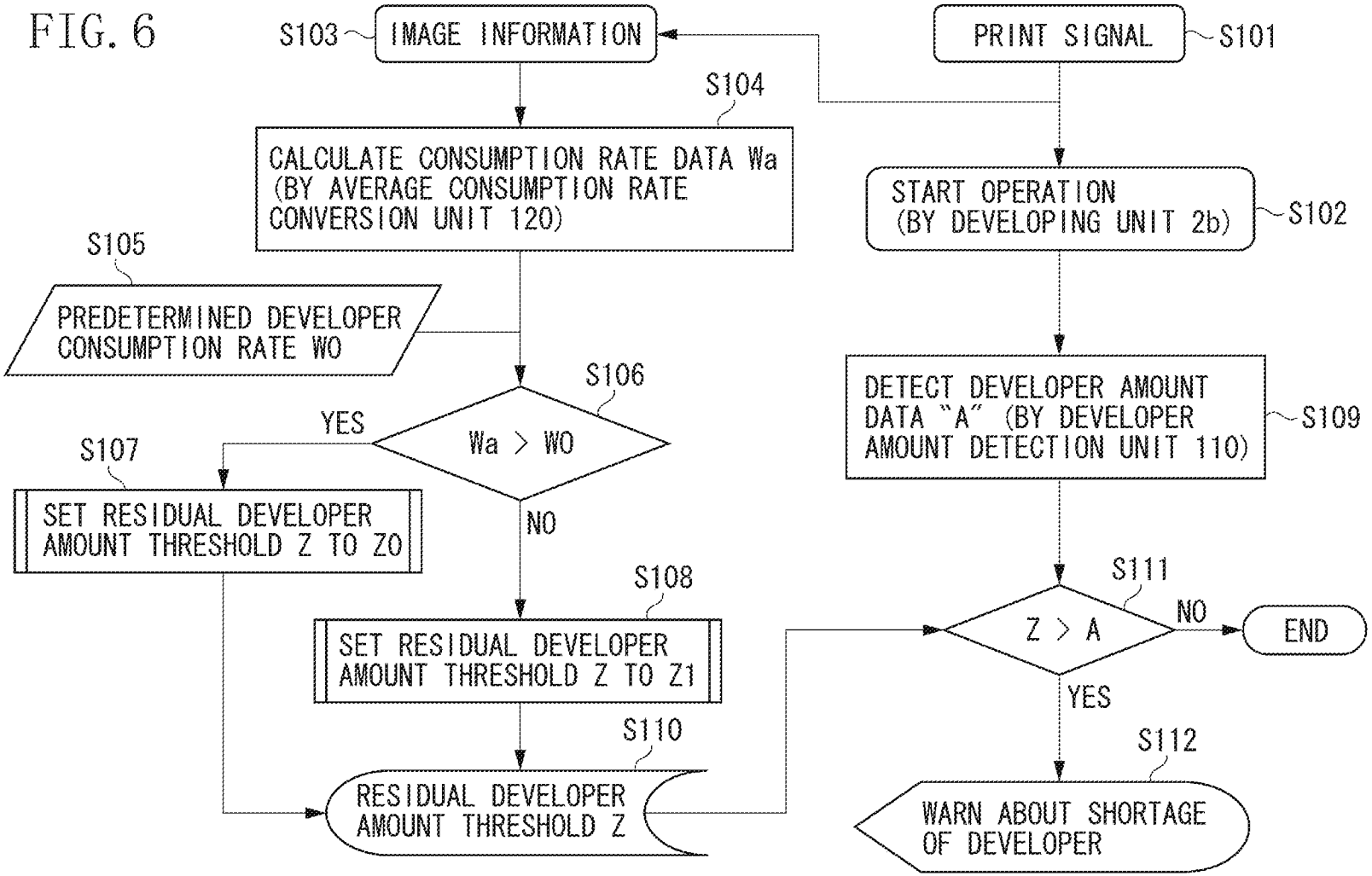
FIG. 6 is a sequence diagram illustrating an example selection control according to the first exemplary embodiment of the present invention.

Similar to the first exemplary embodiment, the control device notifies a user of a coming shortage of the developer based on the consumption rate data Wa according to the sequence illustrated in FIG. 6.

For example, it is now presumed that there are two, i.e., first and second, image forming conditions. The second image forming condition is smaller in print rate than the first image forming condition. In other words, because of smallness in print rate, the developer consumption amount per unit rotation time of the developing roller 22 according to the second image forming condition becomes smaller than that of the first image forming condition, during a time duration from the initial usage stage of the developing unit 2*b* until the control device transmits the information signal.

If the image forming apparatus performs an image forming operation according to each of the above-described two conditions, a difference will be recognized in the amount of the developer remaining in the discharged developer storage container 29 at the time when the control device transmits the information signal.

According to the first image forming condition, the residual developer amount threshold Z becomes a smaller value because the consumption rate data Wa becomes greater. Therefore, at the time when the control device transmits the information signal (i.e., the time when a coming shortage of the developer is notified), the amount of the developer remaining in the developer storage container according to the first image forming condition becomes smaller than that according to the second image forming condition.

When the above-described control is performed, it is possible to obtain effects similar to those described in the first exemplary embodiment. Since the above-described control according to the second exemplary embodiment is performed based on the developing roller rotation time, the deterioration degree of the developer can be accurately detected, compared to the control described in the first exemplary embodiment. For example, when an image forming operation is performed, the developing roller causes a significant amount of rotations as part of the preliminary preparation or the post-processing for the image forming operation.

Accordingly, even when the number of sheets to be used in the image forming operation remains the same, the time required for the developing roller to rotate for the preliminary preparation or the post-processing changes significantly depending on the content of the image forming operation. For example, the rotation time of the developing roller required to perform the image forming operation continuously for ten sheets is different from the rotation time required to perform the image forming operation intermittently for ten sheets. In other words, the difference (i.e., continuous or intermittent) in the image forming operation is taken into consideration in the control according to the second exemplary embodiment.

The following exemplary embodiment is characterized in the control procedure of notifying a user of a coming shortage of the developer. The control device described in the first exemplary embodiment decreases the predetermined value of the residual developer amount at which the control device notifies a user of a coming shortage of the developer when the average developer consumption rate data exceeds a predetermined value.

On the contrary, in the present exemplary embodiment, there is a plurality of predetermined values with respect to the residual developer amount at which the control device notifies a user of average developer consumption rate data and a coming shortage of the developer. The image forming apparatus according to the present exemplary embodiment includes a developer amount detection unit and an average developer consumption rate conversion unit that are similar to those described in the first exemplary embodiment.

Figure 8:
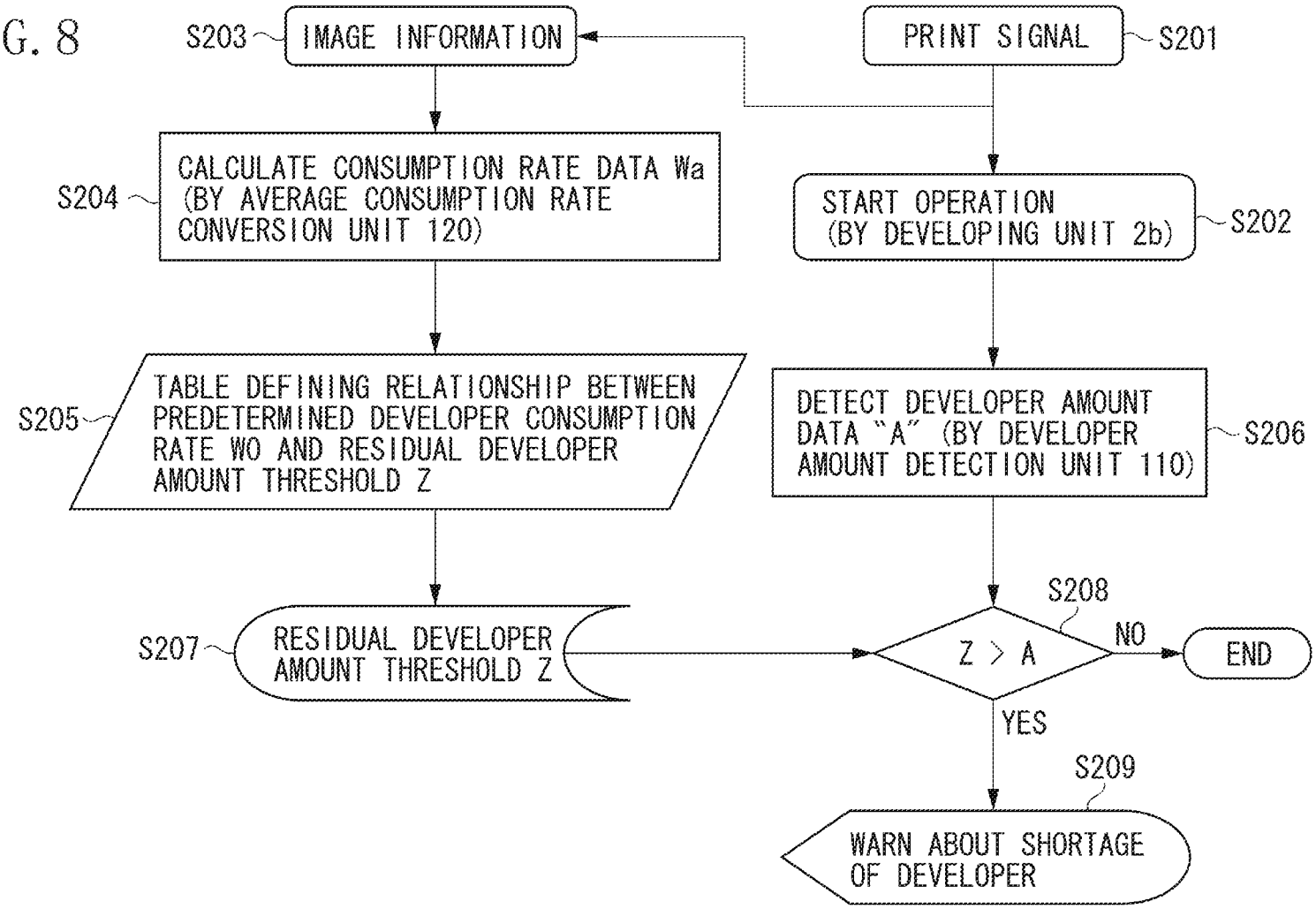
FIG. 8 is a sequence diagram illustrating an example selection control according to a fourth exemplary embodiment of the present invention.

More specifically, a control system according to the present exemplary embodiment has a configuration similar to the system illustrated in FIG. 5 described in the first exemplary embodiment. An example control according to the present exemplary embodiment is described in detail below with reference to a sequence diagram illustrated in FIG. 8.

In step S201, a print signal is sent to the image forming apparatus. In step S202, the image forming apparatus starts an image forming operation and the developing unit 2*b* starts its operation. Further, in step S203, image information received together with the print signal is sent to the average consumption rate conversion unit 120. In step S204, the average consumption rate conversion unit 120 calculates the consumption rate data Wa. In step S205, the control system determines a residual developer amount threshold Z with reference to a table having been set beforehand that defines a relationship between the predetermined developer consumption rate W0 and the residual developer amount threshold Z (see step S205).

On the other hand, in step S206, the developer amount detection unit 110 detects the developer amount data "A." Then, in step S208, the control device compares detected developer amount data "A" with the above-described residual developer amount threshold Z (see step S207). If it is determined that the developer amount data "A" is smaller than the residual developer amount threshold Z (YES in step S208), then in step S209, the control device notifies a user of a coming shortage of the developer.

FIG. 9 is an example of the above-described table that defines the relationship between the predetermined developer consumption rate W0 and the residual developer amount threshold Z (see step S205). As understood from the contents of the illustrated table, the residual developer amount threshold Z becomes smaller when the predetermined developer consumption rate W0 becomes greater.

In the present exemplary embodiment, instead of employing the table illustrated in FIG. 9, the control device can perform similar calculation using a relational expression that complements the relationship between the predetermined developer consumption rate W0 and the residual developer amount threshold Z. As described above, an appropriate table is employable. Further, it is useful to employ a method for obtaining the consumption rate data Wa based on the rotation time of the developing roller as described in the second exemplary embodiment.

A residual developer amount detection unit according to the present invention is not limited to the light-transmission type remaining amount detection unit described in the above-described exemplary embodiments. For example, a remaining amount detection method based on an electrostatic capacity amount or a residual developer amount detection method based on image information is employable.

The electrostatic capacity based developer amount detection is characterized by detecting the electrostatic capacity amount between the developing roller 22 and the developer feed roller 72. In this case, the electrostatic capacity amount is proportional to the specific inductive capacity of an intervening substance existing between the developing roller 22 and the developer feed roller 72. The specific inductive capacity is equal to 1 if the intervening substance is air, or is equal to or greater than 1 if the intervening substance is the developer. Therefore, the electrostatic capacity amount is variable depending on the amount of the developer existing between the developing roller 22 and the developer feed roller 72. Thus, the developer amount data "A" is acquirable by obtaining the electrostatic capacity amount.

In general, the consumption amount of the developer becomes greater in proportion to the pixel information (i.e., the number of pixel signals (i.e., pixel count number)) of an output image, as image information of an image to be formed on a recording material in an image forming operation. Hence, the following calculation formula is applicable to estimate a toner consumption amount Q.

$$Q=PC\times Wdot \tag{2'}$$

In the present exemplary embodiment, Q represents the developer consumption amount, PC represents the pixel count value, and Wdot represents the developer consumption amount per pixel.

Thus, it is possible to estimate the developer usage amount by integrating the developer consumption amount Q defined by the above-described formula (2') based on the pixel information of an output image. It is possible to calculate the remaining developer amount by subtracting the developer usage amount from the initial amount of the developer filled in a brand-new developing unit 2*b*. Then, the developer amount data "A" can be obtained based on the calculated remaining developer amount. As described above, the present invention is applicable to another residual developer amount detection unit.

As described above, it is possible to calculate the remaining amount of the developer based on information relating to the residual developer amount (e.g., electrostatic capacity amount value or pixel count value) obtainable from a residual developer amount detection device. Then, if it is determined that the calculated remaining amount of the developer is smaller than a threshold value, the control device can transmit the information signal notifying a coming shortage of the developer.

As described above, the deterioration of the developer gradually advances in accordance with the rotation of the developing roller that carries the developer. Further, the deterioration degree of the developer is variable depending on the amount of the remaining developer. It is generally believed that the deterioration of the developer advances greatly if the remaining developer amount is smaller.

Therefore, in the present exemplary embodiment, the control device obtains an index indicating the deterioration degree of the developer with reference to a relationship between the rotation time of the developing roller and the developer consumption amount (remaining amount), with respect to the average developer consumption rate. Then, based on the obtained value, the control device determines a reference remaining developer amount to be referred to when the control device notifies that the usage limit of the developing device will soon come. The image forming apparatus according to the present exemplary embodiment includes a developer amount detection unit that is similar to that described in the above-described exemplary embodiments.

First, the deterioration degree of the developer is described below. In the present exemplary embodiment, the deterioration degree of the developer indicates the deterioration degree of the entire developer. The deterioration of the developer advances greatly if the rotation time of the developing roller is longer.

In the relationship with the amount of the developer remaining in the developing unit 2*b*, the deterioration advances greatly when the remaining developer amount is smaller, compared to the case where the remaining developer amount is greater, if the rotation time of the developing roller is the same. More specifically, in a case where apart of the developer has deteriorated because of the rotation of the developing roller, the percentage of the deteriorated developer is relatively smaller if the remaining developer amount is greater. Therefore, the deteriorated developer has a smaller influence on the entire developer.

On the other hand, it is believed that the deteriorated developer has a greater influence on the entire developer if the remaining developer amount becomes smaller.

An example method for checking the relationship between the developer deterioration degree and the rotation time of the developing roller, in relation to the remaining developer amount, is described below.

The example method includes preparing a plurality of types of developing units 2*b*, which are different in the filling amount of the developer. The method further includes attaching each prepared unit to the image forming apparatus to perform durable printing to form images at lower print rates (or print without images), and obtaining the number of sheets on which the image defective (e.g., fogging occurring in a white region of an image) is generated, i.e., the rotation time of the developing roller.

Figure 10:
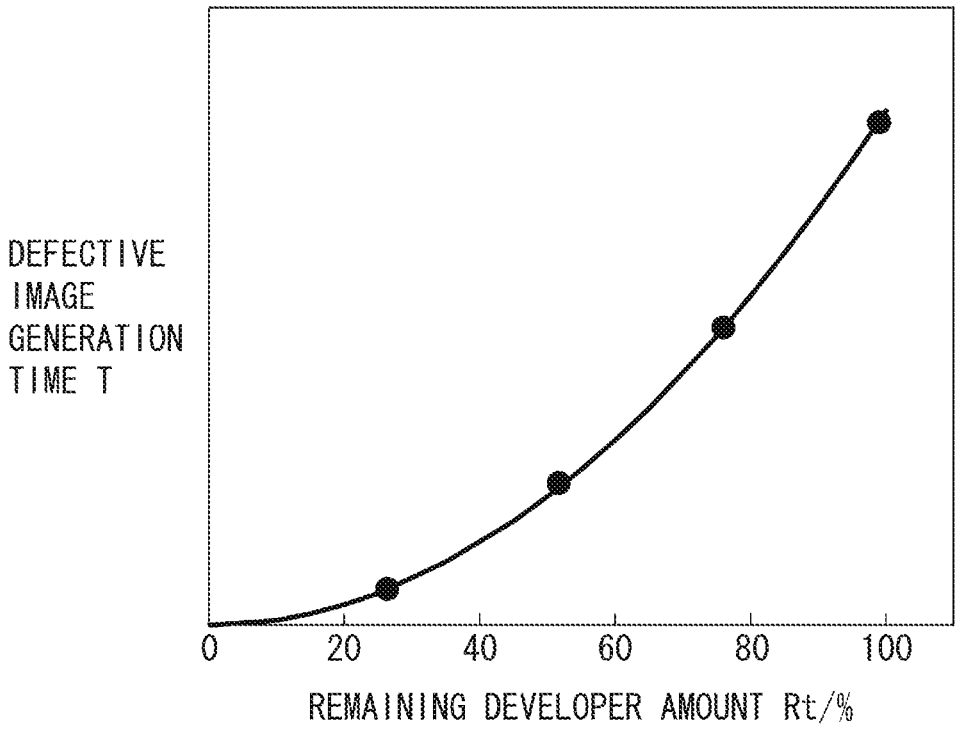
FIG. 10 is a graph illustrating a relationship between remaining developer amount and defective image generation time according to a fifth exemplary embodiment of the present invention.

FIG. 10 illustrates a relationship between the remaining developer amount and the defective image generation time. A unit that is smaller in the filling amount of the developer reflects the case where the developer amount Rt remaining in the unit is smaller. On the other hand, a unit that is greater in the filling amount of the developer reflects the case where the developer amount Rt remaining in the unit is greater.

If the unit is smaller in the filling amount of the developer (i.e., when the remaining developer amount Rt is smaller), a defective image is generated when the rotation time T of the developing roller is shorter. On the other hand, if the unit is greater in the filling amount of the developer (i.e., when the remaining developer amount Rt is greater), no defective image is generated before the rotation time T of the developing roller becomes longer. For example, the above-described result can be expressed using the following formula.

$$T=A\times Rt^n \tag{3}$$

In the present exemplary embodiment, "A" represents an arbitrary constant and "n" represents an arbitrary exponent.

Next, a developer deterioration degree Dt per unit time in the rotation of the developing roller is described below. The reciprocal of the defective image generation time T is equal to a value representing the deterioration degree of the developer per unit time in the rotation of the developing roller. More specifically, a developer deterioration coefficient D' per unit time in the rotation of the developing roller can be expressed using the following formula.

$$D'=1/T=C/Rt^n \tag{4}$$

Figure 11:
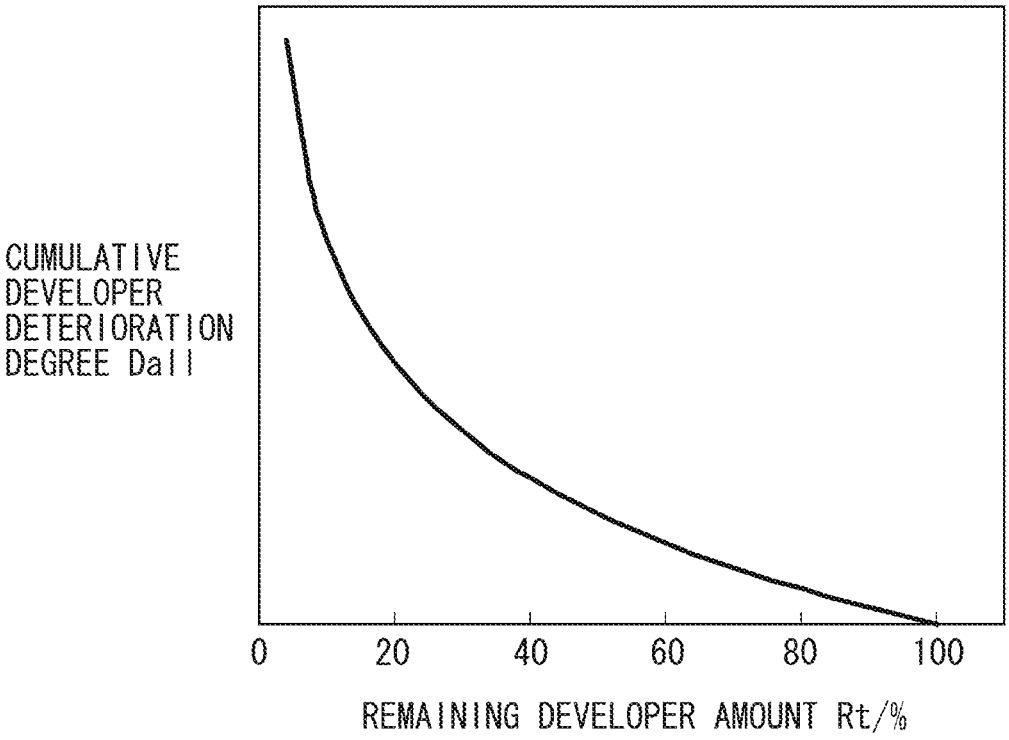
FIG. 11 is a graph illustrating a relationship between cumulative developer deterioration degree per unit time of developing roller rotation and remaining developer amount according to the fifth exemplary embodiment of the present invention.

In the present exemplary embodiment, D' represents the developer deterioration coefficient, C represents an arbitrary constant, and "n" represents an arbitrary exponent. FIG. 11 is a graph obtainable based on the formula (4), which illustrates a relationship between the developer deterioration degree per unit time in the developing roller rotation and the remaining developer amount. As understood from the relationship illustrated in FIG. 11, the developer deterioration coefficient is greater when the remaining developer amount Rt is smaller. The developer deterioration coefficient is smaller when the remaining developer amount Rt is greater.

The developer deterioration degree Dt can be obtained as a product of the developer deterioration coefficient D' and the number of developing roller rotations DT. Then, a cumulative developer deterioration degree Dall can be obtained by integrating the developer deterioration degree Dt.

The method for estimating the deterioration degree of the developer is employable based on the above-described formula (4), the rotation time of the developing roller, and the remaining developer amount. In the present exemplary embodiment, to simplify the following description, it is presumed that the constant C is equal to 1 and the exponent "n" is equal to 1 in the formula (4).

$$D'=1/Rt \tag{4'}$$

In general, the constant C and the exponent "n" have practical values that are variable depending on the configuration of each apparatus.

Figure 12:
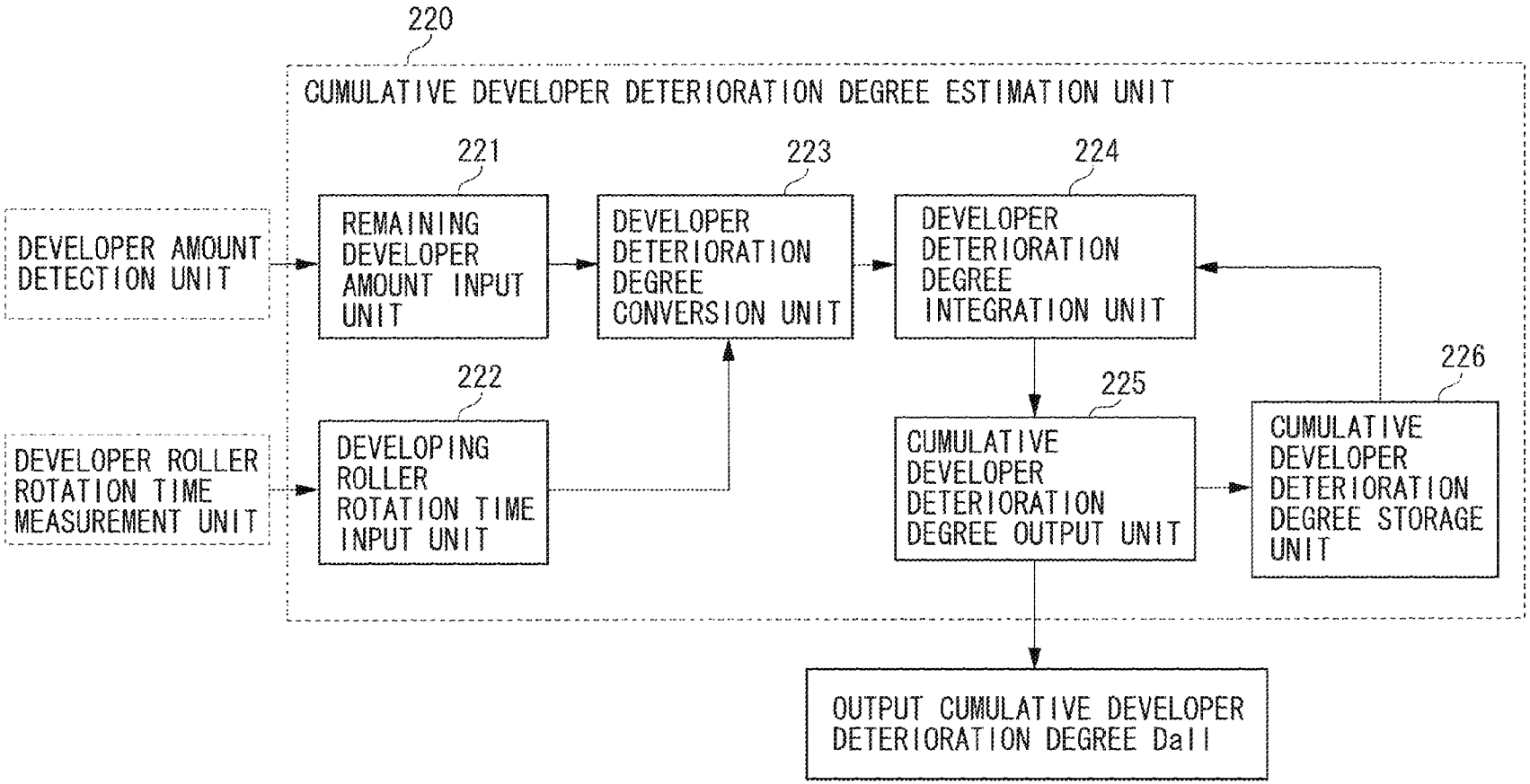
FIG. 12 is a block diagram illustrating a circuit configuration of a cumulative developer deterioration degree estimation unit according to the fifth exemplary embodiment of the present invention.

Next, an example method for estimating the developer deterioration degree is described below. FIG. 12 is a block diagram illustrating a circuit configuration of a cumulative developer deterioration degree estimation unit 220 according to the present exemplary embodiment.

The cumulative developer deterioration degree estimation unit 220 includes a remaining developer amount input unit 221, a developing roller rotation time input unit 222, a developer deterioration degree conversion unit 223, and a developer deterioration degree integration unit 224. Further, the cumulative developer deterioration degree estimation unit 220 includes a cumulative developer deterioration degree output unit 225 and a cumulative developer deterioration degree storage unit 226.

The developer amount detection unit inputs remaining developer amount information to the remaining developer amount input unit 221. The rotation time DT of the developing roller 22 is substantially similar to the driving time of the driving mechanism of the developing unit 2*b*.

Therefore, the developing roller rotation time input unit 222 receives developing roller rotation time information from the driving time measurement unit of the driving mechanism (not illustrated) of the developing unit 2*b*, and sends the received developing roller rotation time information to the developer deterioration degree conversion unit 223. The developer deterioration degree conversion unit 223 obtains a converted developer deterioration degree Dt according to the above-described formula (4'), and sends the obtained developer deterioration degree Dt to the developer deterioration degree integration unit 224.

The developer deterioration degree integration unit 224 obtains an integration value Dall by integrating the developer deterioration degree Dt sent from the developer deterioration degree conversion unit 223 with the developer deterioration degree information stored in the cumulative developer deterioration degree storage unit 226. Then, the developer deterioration degree integration unit 224 calculates a new cumulative developer deterioration degree Dall. The developer deterioration degree integration unit 224 outputs the new cumulative developer deterioration degree Dall to the cumulative developer deterioration degree output unit 225.

The cumulative developer deterioration degree output unit 225 stores the new information in the cumulative developer deterioration degree storage unit 226. Further, the cumulative developer deterioration degree output unit 225 outputs the new information, as the cumulative developer deterioration degree Dall of the developing unit 2*b*, to the control unit 240.

The cumulative developer deterioration degree estimation unit can calculate the cumulative developer deterioration degree Dall at appropriate frequency and timing as described below.

For example, it is useful to update the cumulative developer deterioration degree Dall every unit time (e.g., every second or every ten seconds) with respect to the rotation time of the developing roller or at the time when the printing of a predetermined number of (e.g., one or ten) sheets is completed. Further, it is useful to perform the above-described calculation of the cumulative developer deterioration degree Dall at the timing of post rotation to be performed when the print operation is terminated.

Figure 13:
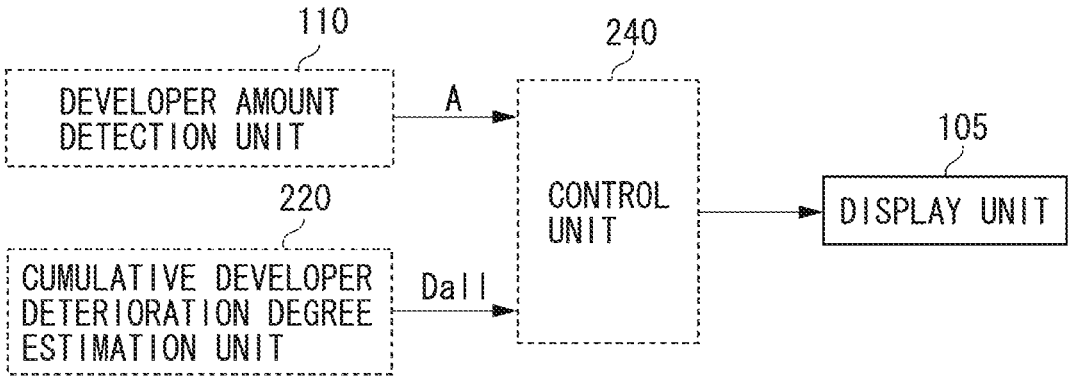
FIG. 13 is block diagram illustrating a control system according to the fifth exemplary embodiment of the present invention.

FIG. 13 is a block diagram illustrating a control system according to the present exemplary embodiment. As illustrated in FIG. 13, the control unit 240 receives the detection data "A" from the developer amount detection unit 110 and the cumulative developer deterioration degree Dall from the cumulative developer deterioration degree estimation unit 220. The control unit 240 is connected to the display unit 105 of the image forming apparatus and outputs information to the display unit 105.

Figure 14:
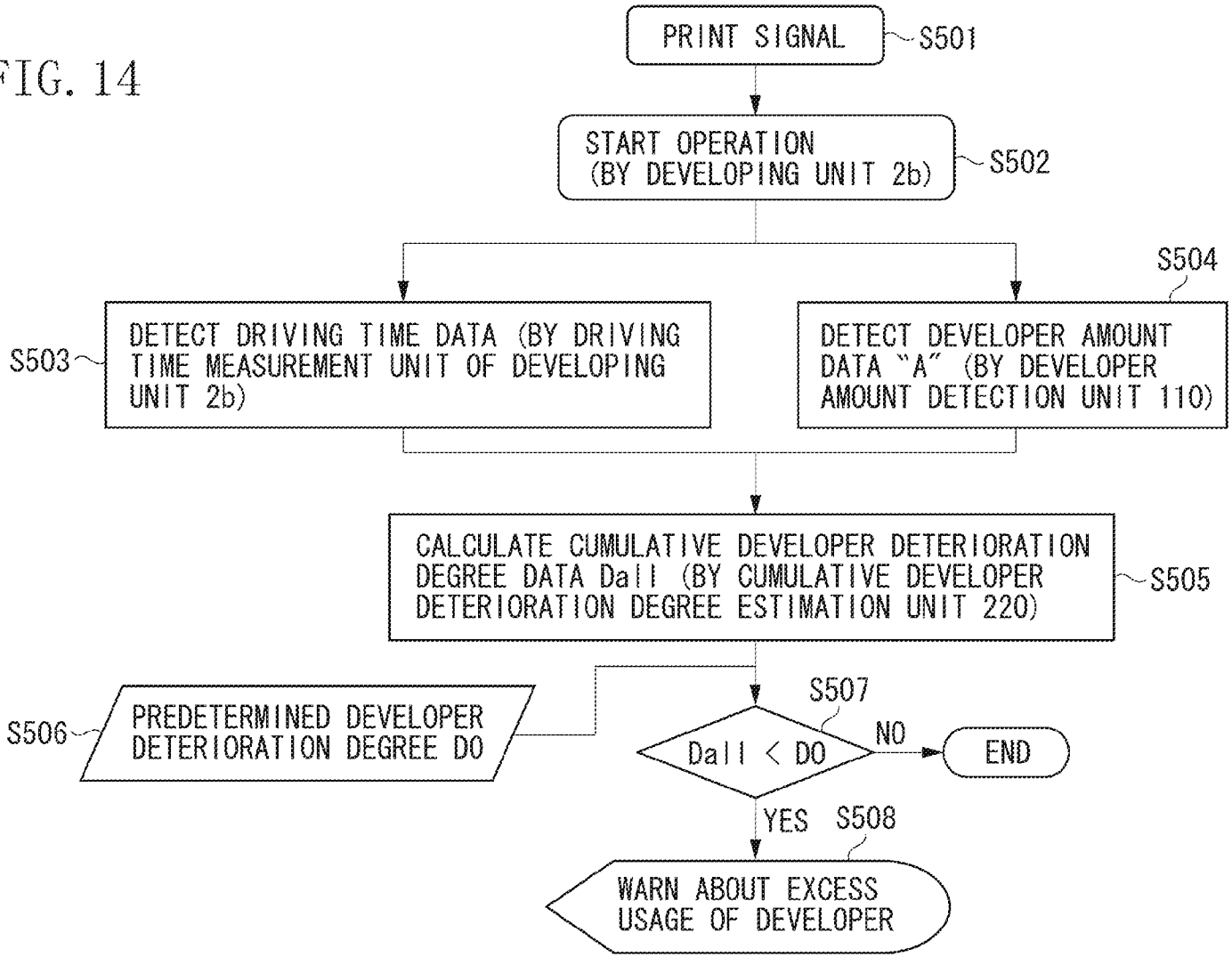
FIG. 14 is a sequence diagram illustrating an example selection control according to the fifth exemplary embodiment of the present invention.

An example control that can be performed by the control unit 240 is described in detail below with reference to a sequence diagram illustrated in FIG. 14.

In step S501, a print signal is sent to the image forming apparatus. In step S502, the image forming apparatus starts an image forming operation and the developing unit 2*b* starts its operation. In step S503, the driving time measurement unit of the developing unit 2*b* detects driving time data. In step S504, the developer amount detection unit 110 detects the developer amount data "A." In step S505, the cumulative developer deterioration degree estimation unit 220 calculates a cumulative developer deterioration degree data Dall based on the driving time data obtained in step S503 and the developer amount data "A" obtained in step S505.

In step S507, the control unit 240 compares the cumulative developer deterioration degree data Dall with a predetermined developer deterioration degree D0 having been set beforehand (see step S506). If it is determined that the cumulative developer deterioration degree data Dall is smaller than the predetermined developer deterioration degree D0 (YES in step S507), then in step S508, the control unit 240 notifies a user of excess usage of the developer.

If the above-described control is performed, for example, in a case where the image forming apparatus performs operations while changing the image forming conditions, the amount of the developer remaining in the developer storage container is variable at the time when the control device transmits an information signal notifying the excess usage of the developer.

As described in the first exemplary embodiment, it is presumed that there are two, i.e., first and second, image forming conditions. The second image forming condition is smaller in print rate than the first image forming condition. In this case, the developer deterioration degree becomes smaller when the selected condition is the first image forming condition if the remaining developer amount is the same.

Therefore, the amount of the developer remaining in the developer storage container at the time when the control device transmits the information signal (notifying the excess usage of the developer) is relatively smaller if the first image forming condition is selected, compared to the developer amount remaining in the second image forming condition.

Figure 15:
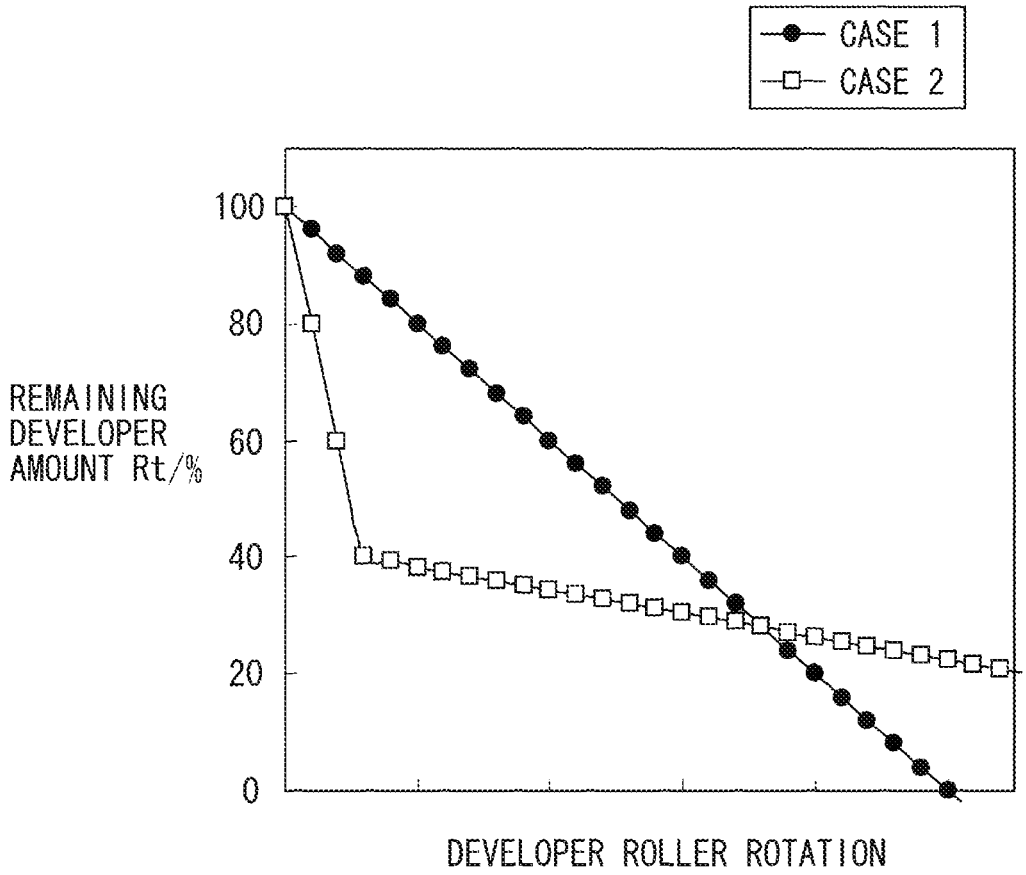
FIG. 15 is a graph illustrating developer consumption patterns according to the fifth exemplary embodiment of the present invention.

Next, an example case where a developer consumption pattern changes in response to a change in the print rate in the process of using the developing unit is described below. FIG. 15 is a graph illustrating examples of the developer consumption pattern, in which the abscissa axis represents the number of developing roller rotations and the ordinate axis represents the remaining developer amount. The number of developing roller rotations (i.e., see the abscissa axis) can be replaced by the number of printed sheets in the same paper-feeding mode of the image forming apparatus.

For example, performing an image forming operation at the same print rate during a time duration from the initial usage stage of the developing unit 2*b* until the control device transmits the information signal is referred to as "third image forming condition." If the operational condition of the image forming apparatus is set to the third image forming condition, the remaining developer amount monotonously decreases as indicated by "case 1" in FIG. 15. Hereinafter, in each graph of FIGS. 15 to 17, the case 1 indicates the result of image formation according to the third image forming condition.

Next, performing an image forming operation at a print rate higher than that of the third image forming condition in the initial usage stage of the developing unit 2*b* and subsequently performing an image forming operation at a print rate lower than that of the third image forming condition is referred to as "fourth image forming condition." If the operational condition of the image forming apparatus is set to the fourth image forming condition, the remaining developer amount decreases as indicated by "case 2" in FIG. 15. Hereinbelow, in each graph of FIGS. 15 to 17, the case 2 indicates the result of image formation according to the fourth image forming condition.

Figure 16:
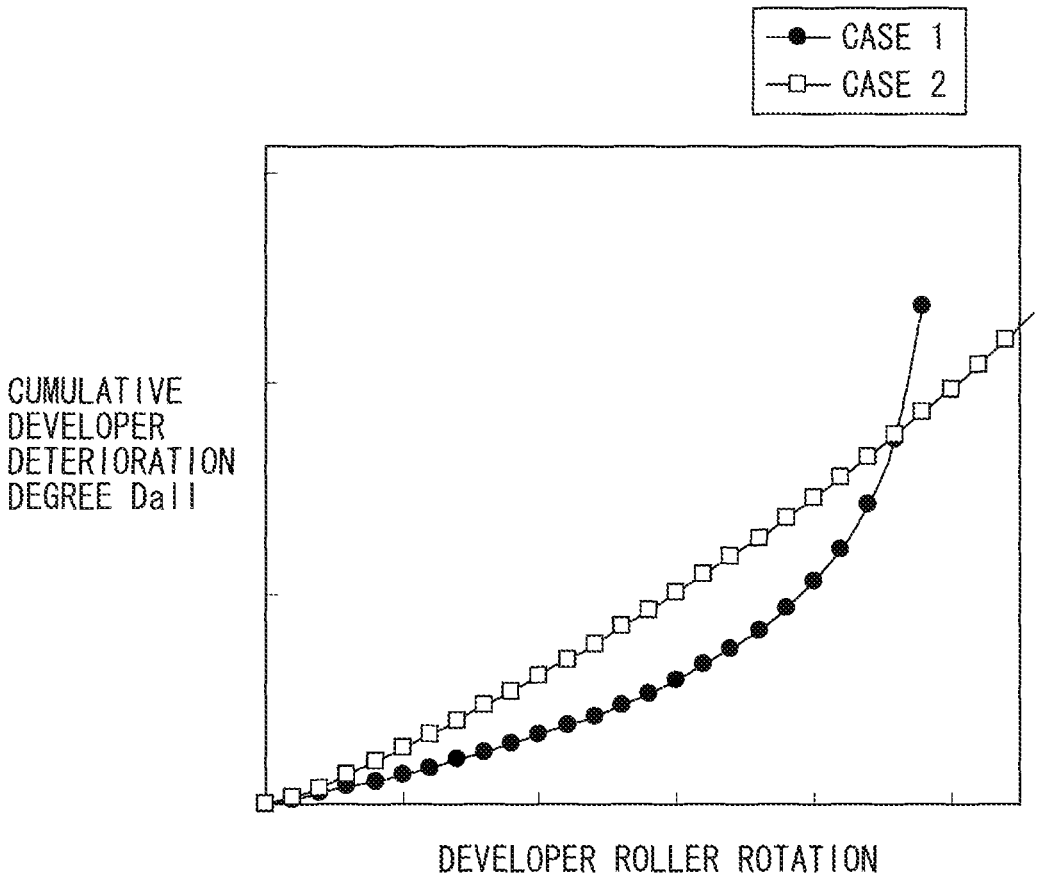
FIG. 16 is a graph illustrating a relationship between cumulative developer deterioration degree and the developing roller rotation according to the fifth exemplary embodiment of the present invention.

FIG. 16 is a graph illustrating a relationship between the cumulative developer deterioration degree Dall and the number of developing roller rotations in each of the third image forming condition and the fourth image forming condition.

If the operational condition of the image forming apparatus is set to the fourth image forming condition, the image forming operation is performed at a relatively higher print rate in the initial usage stage of the developing unit compared to the image forming operation according to the third image forming condition. Therefore, the remaining developer amount is relatively smaller in the fourth image forming condition compared to the amount in the third image forming condition (see FIG. 15).

Subsequently, if the print rate of the image forming apparatus is switched to a lower value, as described above, the developer deterioration coefficient becomes greater when the remaining developer amount is smaller. Therefore, even if the rotation time of the developing roller is the same, the cumulative developer deterioration degree becomes higher when the fourth image forming condition is set (see FIG. 16).

Figure 17:
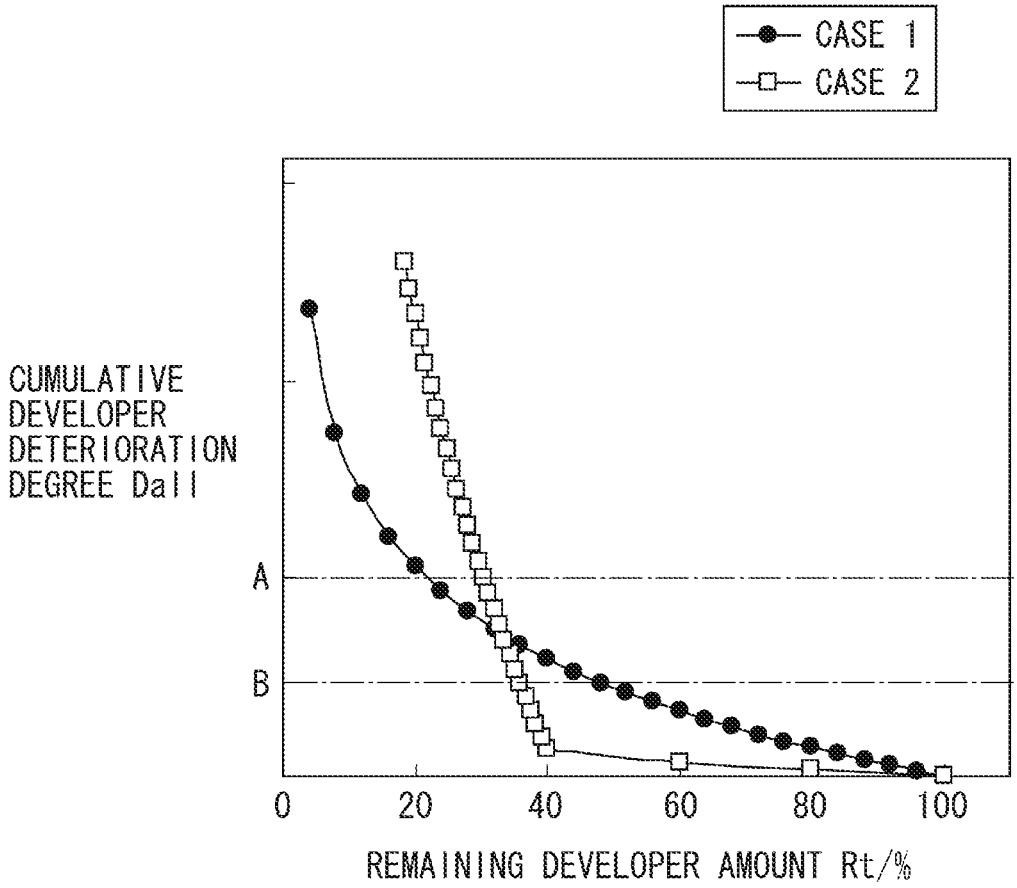
FIG. 17 is a graph illustrating a relationship between cumulative developer deterioration degree (Dall) and remaining developer amount (Rt) according to the fifth exemplary embodiment of the present invention.

FIG. 17 is a graph illustrating a relationship between the cumulative developer deterioration degree Dall and the remaining developer amount Rt in each of the third image forming condition and the fourth image forming condition. It is understood if a usage limit of the developing unit is set to level "A" illustrated in FIG. 17, the developer can be used until the residual developer amount becomes smaller when the fourth image forming condition (i.e., the case 2) is selected, because the deterioration of the developer is relatively slow.

Therefore, in a case where the operational condition of the image forming apparatus is set to the fourth image forming condition, the timing when the control device transmits the information signal is too early and, as a result, a relatively large amount of developer remains in the developer storage container.

Therefore, the amount of the developer remaining in the developer storage container at the time when the control device transmits the information signal (notifying a coming shortage of the developer) is relatively smaller if the third image forming condition is selected, compared to the remaining amount in the fourth image forming condition. However, in a case where a usage limit of the developing unit is set to level "B" illustrated in FIG. 17, the amount of the developer remaining in the developer storage container at the time when the control device transmits the information signal is relatively greater if the third image forming condition is selected, compared to the remaining amount in the fourth image forming condition.

As described above, if the operational condition of the image forming apparatus is selectable between two conditions, the amount of the developer remaining in the discharged developer storage container 29 is not constant at the time when the control device transmits the information signal.

The present exemplary embodiment is characteristic in that the concept "developer deterioration degree" is taken into consideration and the amount of the developer remaining in the developer storage container at the usage limit of the developing unit is variable depending on the usage history starting from the initial usage stage of the developing unit. According to the method described in the first exemplary embodiment or the second exemplary embodiment, the usage limit of the developing unit depends on the total print rate during a time duration from the initial usage stage of the developing unit until certain timing, irrelevant to the usage history of the developing unit.

In a fifth exemplary embodiment, even if the total print rate is the same at a certain timing, the deterioration degree of the developer is dependent on the usage history (see case 1 and case 2 illustrated in FIG. 15) and has a significant influence on the usage limit of the developing unit. Accordingly, the fifth exemplary embodiment is useful in that the accuracy in detecting the deterioration degree of the developer can be further improved compared to the first and second exemplary embodiments.

According to the control described in the present exemplary embodiment, the usage limit of the developer stored in the developing unit 2*b* is determined based on the cumulative developer deterioration degree data Dall calculated by the cumulative developer deterioration degree estimation unit 220. Thus, the present exemplary embodiment can provide a method for effectively using the developer for a relatively long time without causing any image defective in the usage state of any user.

Although the above-described formulae (3), (4), and (4') have been employed in the exemplary embodiments, it is also useful to use a table that defines a relationship between the deterioration degree of the developer and the rotation time of the developing roller in relation to the residual developer amount.

Further, the method for calculating the developer deterioration degree Dall is not limited to the above-described method for performing calculation based on the rotation time of the developing roller. As described in the first exemplary embodiment, it is useful to calculate the deterioration degree Dall with reference to the number of recorded sheets. In this case, the deterioration degree Dall can be calculated as a product of the deterioration degree coefficient Dt and the number of recorded sheets.

In the above-described exemplary embodiment, the control device obtains the developer consumption amount about the usage of the developer in an image forming operation. However, it may be useful that the developer consumption in an operation other than the image formation is also taken into consideration. For example, a control mode of the image forming apparatus may include supplying the developer as a lubricant to a contact portion between the photosensitive member and the cleaning blade (cleaning the developer off the photosensitive member) at an appropriate timing when no image formation is performed.

If the image forming apparatus has the above-described control mode, the deterioration degree of the developer can be more accurately detected by taking the amount of the developer consumed as the lubricant into consideration in the calculation of the developer consumption rate Wa or the developer deterioration degree data Dall. However, the amount of the developer to be consumed in an operation other than the image formation is relatively smaller, compared to the amount of the developer to be used in the image forming operation. Therefore, the above-described consumption of the developer not used for the image formation can be disregarded if its influence on the deterioration degree of the developer is negligible.

Further, in the above-described exemplary embodiment, the display unit 105 is configured to notify a user of a coming shortage of the developer or a usage limit of the developing device based on the information signal received from the control device. However, the configuration of the display unit 105 is not limited to the above-described example, as long as the control device transmits the information signal relating to the usage limit of the developing device.

For example, it is useful that the image forming apparatus stops its operation in response to the information signal while encouraging a user to exchange cartridges when the remaining developer amount becomes smaller.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-144645 filed Jun. 29, 2011, which is hereby incorporated by reference herein in its entirety.

What is claimed is:

1. An image forming apparatus configured to perform image formation on a recording material, the apparatus comprising:

an image carrier configured to carry a developer image;

a developing device including a developer storage portion configured to store a developer and configured to develop an electrostatic latent image formed on the image carrier;

a remaining amount detection device configured to produce information relating to the remaining amount of the developer stored in the developer storage portion; and a control device configured to transmit an information signal relating to a usage limit of the developing device, wherein the developing device is a developer carrier that carries the developer in a confronting relationship with the image carrier, wherein the control device is configured to calculate a deterioration degree based on a deterioration coefficient that represents the deterioration degree of the developer per unit rotation time of the developer carrier and the rotation time of the developer carrier, wherein the deterioration coefficient is set to be greater when a residual developer amount is smaller, compared to a value when the residual developer amount is greater, and wherein the control device generates the information signal when a cumulative deterioration degree value exceeds a predetermined value.

* * * * *